US007861414B1

(12) United States Patent
Kern

(10) Patent No.: US 7,861,414 B1
(45) Date of Patent: Jan. 4, 2011

(54) CUTTING DEVICE

(76) Inventor: Thomas D. Kern, 3287 County Road 41, Helena, OH (US) 43435

( * ) Notice: Subject to any disclaimer, the term of this patent is extended or adjusted under 35 U.S.C. 154(b) by 181 days.

(21) Appl. No.: 12/001,739

(22) Filed: Dec. 12, 2007

Related U.S. Application Data

(60) Provisional application No. 60/874,208, filed on Dec. 11, 2006.

(51) Int. Cl.
*B26B 27/00* (2006.01)

(52) U.S. Cl. ..... 30/241; 30/92

(58) Field of Classification Search ..... 30/92, 30/124, 165, 182, 184, 241, 242, 249
See application file for complete search history.

(56) References Cited

U.S. PATENT DOCUMENTS 551,041 A * 12/1895 Mueller ..... 30/184
1,197,430 A * 9/1916 Barnes et al. ..... 30/241
2,270,495 A * 1/1942 Bernay ..... 30/184
2,533,962 A * 12/1950 Rowe et al. ..... 30/242
2,541,063 A * 2/1951 Hubbard ..... 30/124
2,914,851 A * 12/1959 Rogers ..... 30/272.1
3,772,782 A * 11/1973 Hunt ..... 30/249
3,855,699 A * 12/1974 Charlett ..... 30/135
5,046,250 A * 9/1991 Huang ..... 30/92
5,261,163 A * 11/1993 Shearhart ..... 30/242
5,304,190 A * 4/1994 Reckelhoff et al. ..... 606/170
5,373,639 A * 12/1994 Huang ..... 30/92
5,483,746 A * 1/1996 Beyers ..... 30/229
5,862,593 A * 1/1999 Huang ..... 30/92
6,115,922 A * 9/2000 Kline ..... 30/229
6,226,872 B1 * 5/2001 Kline ..... 30/134
6,467,172 B1 * 10/2002 Jenq ..... 30/92
6,640,998 B1 * 11/2003 Kern ..... 222/87
2003/0074796 A1 * 4/2003 Lewis ..... 30/228

* cited by examiner

*Primary Examiner*—Hwei-Siu C Payer
(74) *Attorney, Agent, or Firm*—Jerry Semer

(57) ABSTRACT

A cutting tool having a clamp mechanism, a holding device, and a cutting device disposed on one of the clamp mechanism and holding device is disclosed, whereby the clamp mechanism and the cutting device cooperate to cause a severing of a work piece by the cutting device.

3 Claims, 5 Drawing Sheets

CUTTING DEVICE

This application is a continuation-in-part of prior applications No. 60/874,208 that was filed on Dec. 11, 2006.

BACKGROUND OF THE INVENTION

1. Field of the Invention

The present invention relates to a cutting tool and more particularly to a tool adapted to sever a work piece wherein a clamping mechanism and holding device cooperate to cause a severing of the a work piece by a cutting device.

2. Description of the Prior Art

J-channels, vinyl siding, and piping are materials commonly used in the construction of buildings, homes, and other similar structures. J-channels are accessories that attach to a window for a finished edge where exterior siding will be used. J-channels typically abut window trimming and are adapted to receive a portion of the vinyl siding in the channels thereof to provide a finished and aesthetic appearance around the perimeter of the window. Vinyl siding is typically applied to the outside walls of a frame building or home to protect the framing and underlying wood from the elements and to provide ornamental decoration. Piping, typically formed from copper, polyvinyl chloride, and other conventional materials, is used to provide fluid communication to and from the air ducts and plumbing in the home or structure.

During the installation and repair of j-channels and vinyl siding, the dimensions of the area of installation of the j-channel or siding must be measured and then the j-channel or vinyl siding must be measured and cut to the desired length. Typically a handsaw, table saw, or hand shears are utilized to cut j-channels and vinyl siding resulting in jagged or imprecise edges. Furthermore, often the area of installation for the j-channel or vinyl siding is out of an installers reach requiring the installer to climb a ladder or scaffolding, make the appropriate measurement, climb down, and cut the j-channel or vinyl siding to the desired length.

During the installation and repair of piping the same measurement and cutting steps described above must be performed. Typically, a pipe-cutting tool adapted to provide a circumferential cut around the pipe is utilized. Such tools require enough space around the perimeter of the pipe for the tool to be rotated 360 degrees. However, often times piping is abutting or substantially adjacent a wall, floor, or other similar structure and the tool cannot be used to cut the pipe. In this instance a hand saw or other cutting device must be utilized resulting in jagged and imprecisely cut pipe.

Prior art devices for cutting j-channels, vinyl siding, and pipe are either not handheld, are too cumbersome to be carried by an installer, or result in jagged and imprecise cut edges.

An object of the invention is to produce a cutting tool which is easy to use.

Another object of the invention is to produce a cutting tool which is economical and simple in structure.

Still another object of the invention is to produce a cutting tool which is portable thus enabling the user to carry the device with them at all times.

SUMMARY OF THE INVENTION

The above, as well as other objects of the invention, may be other objects of the invention, may be readily achieved by a cutting tool comprising a clamp mechanism; a holding device connected to said clamp mechanism; and a cutting device disposed on one of said clamp mechanism and said holding device, wherein said clamping mechanism and said holding device cooperate to cause a severing of a work piece by said cutting device.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE

Preferred Embodiment of the Invention

Figures 1, 4:
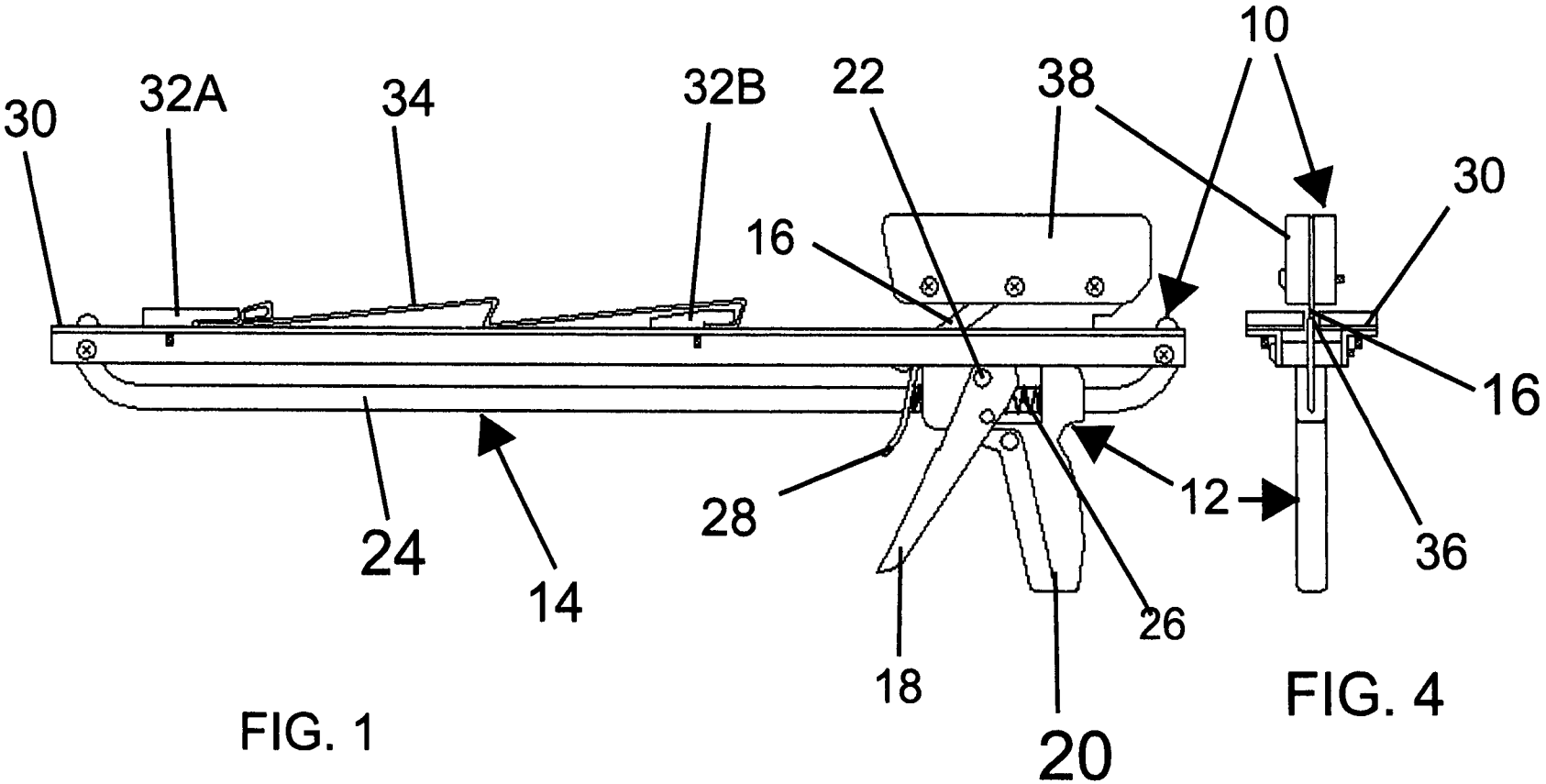
FIG. 1 is a side view of a cutting tool adapted to sever vinyl siding.
FIG. 4 is a side elevational front view of the cutting tool.
Figure 2:
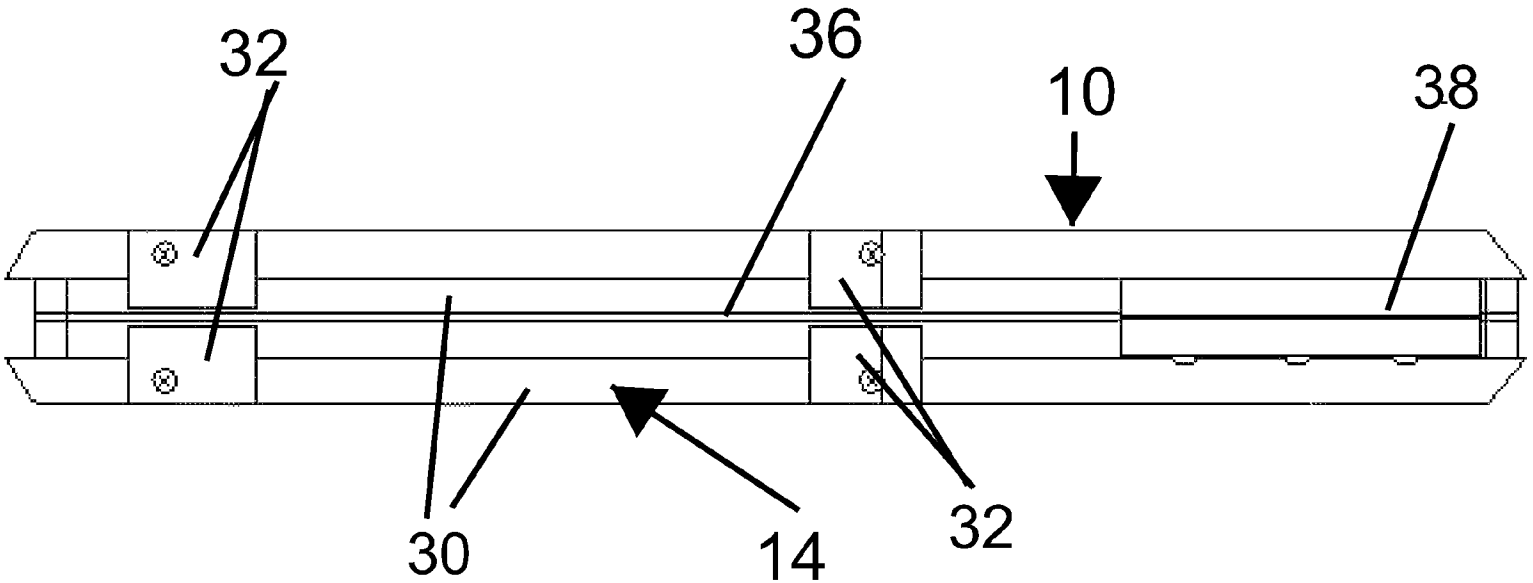
FIG. 2 is a top view of a cutting tool.

Referring now to the drawings, and particularly FIGS. 1, 2 and 4, there is shown generally a cutting tool 10 according to an embodiment of the invention. The cutting tool 10 includes a clamp mechanism 12, a holding device 14, and a cutting device 16. The cutting tool 10 is a handheld device adapted to sever a work piece 34 shown in FIG. 4 on 5 the cutting tool 10, as desired. The cutting tool 10 of FIG. 1 is adapted to sever vinyl siding, the work piece 34.

Figure 1A:
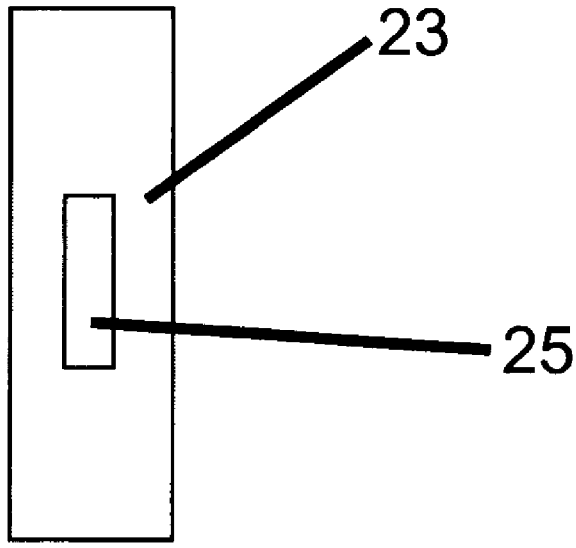
FIG. 1A is a front view of the collar of the cutting tool.

In the embodiment shown in FIG. 1, the clamp mechanism 12 is a trigger operated clamp mechanism. It is understood that the clamp mechanism 12 may be any conventional clamp mechanism, as desired. The clamp mechanism 12 includes an elongate bar 24, operating trigger 18, a collar 23 shown in FIG. 1A, an associated handle grip 20, and a locking lever 28. The clamp mechanism 12 is slidably disposed on the elongate bar 24. The elongate bar 24 is disposed through an axial spring 26, an aperture (not shown) in the trigger 18, the collar 23 with an aperture 25, and an aperture (not shown) in the locking lever 28. A first end of the spring 26 is seated against the handle grip 20. A second end of the spring 26 abutting the locking lever 28. The trigger 18 is pivotally mounted to the clamp mechanism 12 by a pin 22. In the embodiment shown the handle grip 20 is contoured to facilitate the hand grip of a user, however, the handle grip 20 may have any configuration as desired. The collar 23 is disposed in the handle grip 20 of the clamp mechanism 12 and is engaged by the spring 26. The clamp locking lever 28 is pivotally disposed on the clamp mechanism 12 and is adapted to militate against retrograde movement of the elongate bar 24 in a direction opposite to a first axial direction caused by the clamp mechanism 12. The second end of the spring 26 abutting the locking lever 28 urges the locking lever 28 outwardly from the clamp mechanism 12. The locking lever 28 thereby militates against a reverse movement of the elongate bar 24 with respect to the clamp mechanism 12.

In the embodiment shown in *Fig*. 1, the holding device 14 is a plurality of elongate bars 30 having a plurality of mounting brackets 32A and 32 B adapted to receive a portion of the work piece 34. The elongate bars 30 are fixed together to form an intermediate groove 36 there between. The holding device 14 is disposed on the elongate bar 24 of the clamp mechanism 12. It is understood that the plurality of elongate bars 30 may be any number of bars 30 fixed together to form one or more grooves 36 or may be a single bar forming a groove 36, as desired. It is further understood that the mounting brackets 32 A and 32 B may be any conventional device adapted to receive a portion of the work piece 34 including a plurality of rings (not shown), a plurality of apertures (not shown), and a plurality of clips (not shown), for example, as desired.

The cutting device 16 shown in FIG. 1 is a blade, however, it is understood the cutting device 16 may be any conventional device adapted to shear such as a serrated edge, for example, as desired. The cutting device 16 includes a handle 38. The cutting device 16 is disposed on a top of the clamp mechanism 12 with cutting device 16 disposed in the groove 36 formed intermediate the elongate bars 30 of the holding device 14. It is understood the cutting device 16 may be mounted to the holding device 14 as desired. It is also understood that the cutting device 16 may include a plurality of cutting devices 16, as desired.

In operation, the work piece 34 is disposed in and held in position by the holding device 14. h1 the embodiment shown in FIG. I, outer edges of a piece of vinyl siding are disposed in and held in position by the mounting brackets 32A and 32B Next, the trigger 18 is pulled toward the handle grip 20. The trigger 18 is thereby caused to pivot about the pin 22. As the trigger 18 is pulled the spring 26 and the collar 23 are engaged causing to move with the trigger 18 thereby causing the collar 23 to grip the elongate bar 24. The bar 24 is caused to move in the direction of the movement of the trigger 18 and consequently the clamp mechanism 12 is caused to move toward the work piece 34 disposed on the holding device 14. The spring 26 then urges the trigger 18 to return to its original position for a repeat of the action detailed above.

As the trigger 18 is engaged, the bar 24 and the clamping mechanism 12 are axially positioned toward the work piece 34 until the work piece 34 is engaged by the cutting device 16. Once the work piece 34 is engaged the operator may continue to engage the trigger 18 incrementally severing the work piece 34 with each pull of the trigger 18 or the user may engage the trigger 18 and the locking lever 28 to allow the clamping mechanism 12 to freely and slidably reposition relative to the bar 24. If the trigger 18 and the locking lever 28 are simultaneously engaged, the user may push the clamping mechanism 12 toward the work piece 34 to shear the work piece 34 with the cutting device 16 using one smooth motion.

As the bar 24 is moved axially by operation of the operating trigger 18, the locking lever 28 will facilitates the axial movement of the clamp mechanism 12 in the first direction and militates against a reverse movement. At the completion of a severing operation, or when it is desired to replace the work piece 34, the locking lever 28 is grasped and pulled toward the handle grip 20, releasing the bar 24 from the collar 23 allowing the bar 24 to move axially. The spring 26 urges the locking lever 28 to return to its original position, thereby continuing to militate against reverse movement of the bar 24.

Figure 3:
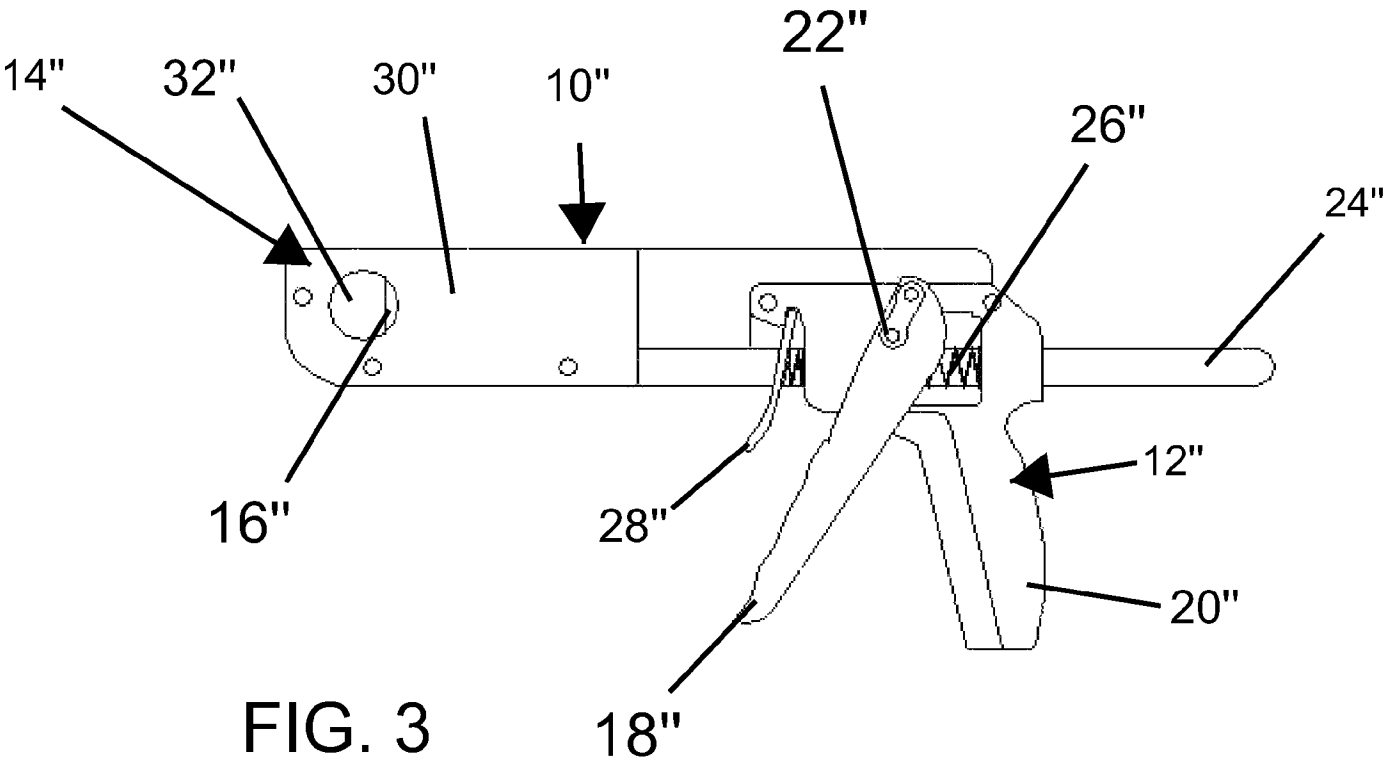
FIG. 3 is a side view of a cutting tool adapted to sever pipe.
Figure 4:
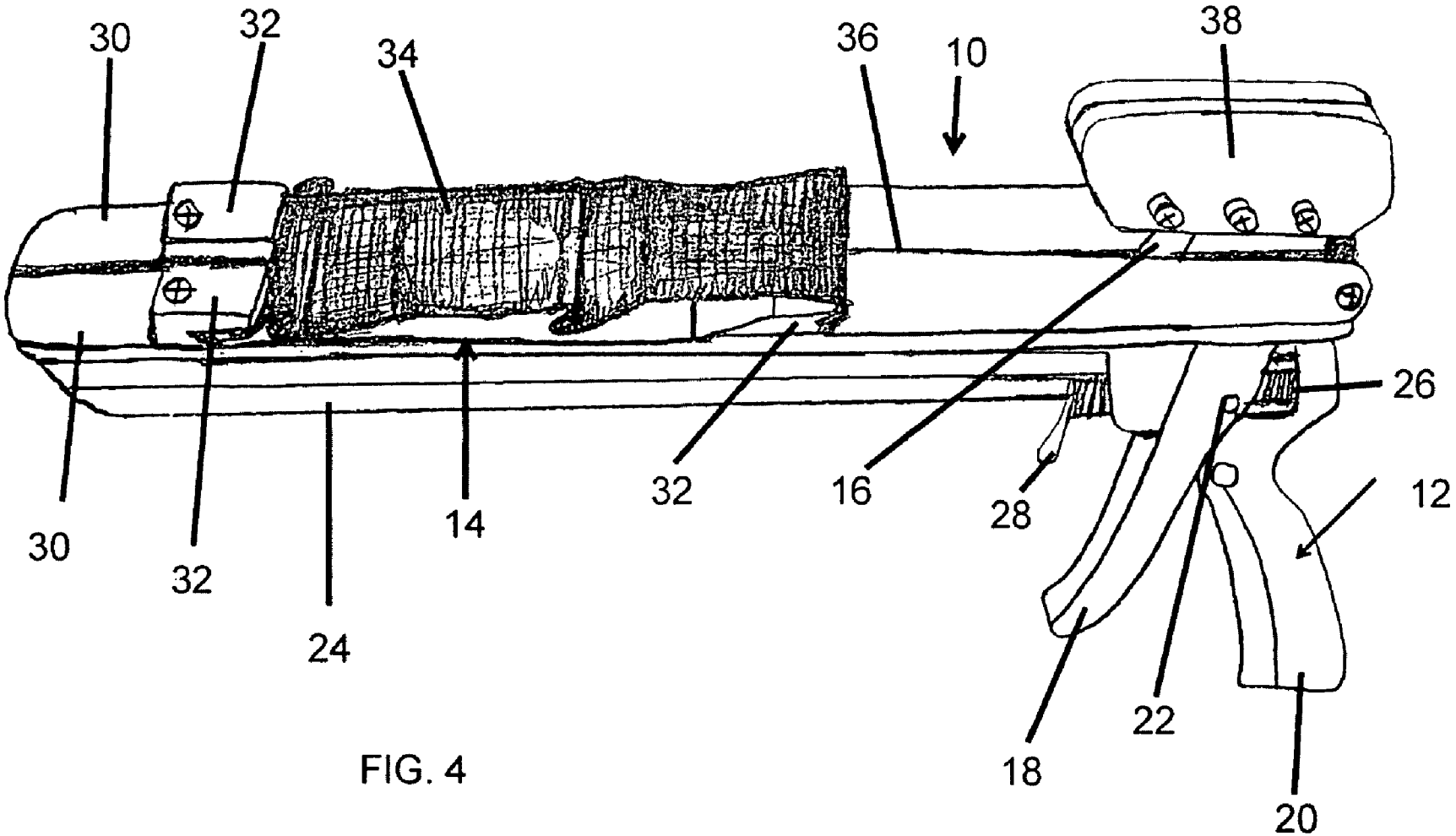

Referring now to the drawings, and particularly FIG. 3, there is shown generally a cutting tool 10" according to another embodiment of the invention. The cutting tool 10" includes a clamp mechanism 12", a holding device 14", and a cutting device 16". The cutting tool 10" is a handheld device adapted to sever a work piece (not shown), as desired. The cutting tool 10" of FIG. 3 is adapted to sever pipe, the work piece.

In the embodiment shown in FIG. 3, the clamp mechanism 12" is a trigger operated clamp mechanism. It is understood that the clamp mechanism 12" may be any conventional clamp mechanism, as desired. The clamp mechanism 12" includes an elongate bar 24", operating trigger 18", a collar 23 shown in FIG. 1A, associated handle grip 20", and a locking lever 28". The clamp mechanism 12" is slidably disposed on the elongate bar 24". The elongate bar 24" is disposed through an axial spring 26", an aperture (not shown) in the trigger 18", the collar 23, and an aperture (not shown) in the locking lever 28". A first end of the spring 26" is seated against the handle grip 20". A second end of the spring 26" abutting the locking lever 28". The trigger 18" is pivotally mounted to the clamp mechanism 12" by a pin 22". In the embodiment shown the handle grip 20" is contoured to facilitate the hand grip of a user, however, the handle grip 20" may have any configuration as desired. The collar 23 is disposed in the handle grip 20" of the clamp mechanism 12" and is engaged by the spring 26". The clamp locking lever 28" is pivotally disposed on the clamp mechanism 12" and is adapted to militate against retrograde movement of the elongate bar 24" in a direction opposite to a first axial direction caused by the clamp mechanism 12". The second end of the spring 26" abutting the locking lever 28" urges the locking lever 28" outwardly from the clamp mechanism 12". The locking lever 28" thereby militates against a reverse movement of the elongate bar 24" with respect to the clamp mechanism 12".

In the embodiment shown in FIG. 3, the holding device 14" is a sheath 30" forming a groove (not shown) adapted to slidably receive the cutting device 16" and having an aperture 32" adapted to receive a portion of the work piece. The sheath 30" is disposed on and coupled to the elongate bar 24" of the clamping mechanism 12". In the embodiment shown in FIG. 3, the aperture 32" has a closed circular shape formed by the sheath 30". It is understood that the aperture 32" formed in the sheath 30" may have any conventional shape such as an ovoid shape, a crescent shape, or a rectangular shape, for example, as desired. It is further understood that the aperture 32" may not be a closed shape and may have a portion not formed by the sheath 30" adapted to receive a work piece that may not be slidably disposed through the aperture 32", such as a work piece abutting a wall or other structure. Where the aperture 32" has an open configuration, the work piece will be positioned in the aperture 32" by abutting the device 10" against the work piece through the open portion rather than slidably positioning the work piece through the aperture 32". It is understood that the sheath 30" may be formed from a unitary material or may be formed from separate a plurality of pieces cooperating to form the sheath 30", as desired.

The cutting device 16" shown in FIG. 3 is a blade, however, it is understood the cutting device 16" may be any conventional device adapted to shear such as a serrated edge, for example, as desired. The cutting device 16" is disposed on a top of the clamp mechanism 12" with cutting device 16" disposed in the groove formed intermediate the sheath 30" of the holding device 14". It is understood the cutting device 16" may be mounted to the holding device 14" as desired. It is also understood that the cutting device 16" may include a plurality of cutting devices 16", as desired.

The operation of the cutting tool 10" shown in FIG. 3 is substantially similar to the operation of the cutting tool 10, as described above.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A cutting tool comprising:

a clamp mechanism;

a holding device with a groove connected to said clamp mechanism and upon said holding device a work piece is disposed; and a cutting device disposed on said clamp mechanism and said holding device and said cutting device are aligned within said groove of the holding device, wherein said clamp mechanism and said holding device cooperate to cause a severing of the work piece by said cutting device disposed partially within said groove of the holding device the clamp mechanism comprises:

an elongated bar; and, a trigger that is pivotally attached to the clamp mechanism, a collar with an aperture that is slidably disposed on the elongated bar; and a handle grip, and, a locking lever slidably disposed on the elongated bar; and, an axial spring through whose center the elongated bar passes and said spring engages the collar and a first end of the spring is seated against the handle grip and a second end of the spring abutting the locking lever, whereas when the trigger is pulled toward the handle grip, the trigger is thereby caused to pivot and as the trigger pivots the axial spring and the collar are engaged causing them to move with the trigger thereby causing the collar to grip the elongated bar and the elongated bar is caused to move in the direction of the movement of the trigger and consequently the work piece disposed on the holding device is caused to move toward the clamp mechanism.

2. The cutting tool according to claim 1, wherein the holding device has a set of mounting brackets that hold the work piece in place for severing.

3. The cutting tool according to claim 2, wherein the holding device is two bars with the mounting brackets on the top and in between the two bars is the groove in which the cutting device is disposed.

* * * * *